US005714215A

United States Patent [19]

Sheffield et al.

[11] Patent Number: 5,714,215

[45] Date of Patent: Feb. 3, 1998

[54] UNITARY FLEXIBLE INFORMATION PRESENTATION BOARD HAVING SELF-SUCTION

[76] Inventors: Douglas Sheffield; Tamara K. Sheffield, both of 6041 Pershing Ave., St. Louis, Mo. 63112

[21] Appl. No.: 212,150

[22] Filed: Mar. 14, 1994

[51] Int. Cl.[6] ..... G09F 21/04; A47G 1/17

[52] U.S. Cl. ..... 428/34.1; 428/31; 428/192; 428/195; 428/337; 40/591; 40/597; 40/611; 40/618; 248/309.3; 248/467; 248/901; 293/117

[58] Field of Search ..... 40/577, 603, 604, 40/611, 618, 591, 593; 428/913.3, 34.1, 31, 332, 192, 195, 337; 248/467, 309.3, 305.5; 296/901, 136, 97.7, 95.1; 280/1, 727; 293/117

[56] References Cited

U.S. PATENT DOCUMENTS

| | | | |
|---|---|---|---|
| 1,076,250 | 10/1913 | Ulrich | 40/597 |
| 1,922,900 | 8/1933 | Plante | 40/597 |
| 1,932,154 | 10/1933 | Briggs | 40/597 |
| 2,559,163 | 7/1951 | MacDonald | 40/592 |
| 4,052,806 | 10/1977 | George | 40/592 |
| 5,077,925 | 1/1992 | Herrera et al. | 40/642 |
| 5,080,941 | 1/1992 | Kosowan | 40/597 |
| 5,131,177 | 7/1992 | Sy, Jr. | 40/597 |

*Primary Examiner*—Rena Dye

[57] ABSTRACT

A unitary flexible information presentation board having self-suction is disclosed. The board comprises a unitary flexible sheet having an exterior convex surface, an interior concave surface and a beveled periphery. Each surface is uniquely tapered to allow the interior concave surface, when placed against a substrate, to form a vacuum seal against said substrate, upon application of pressure from the exterior convex surface and thereby adhere to the substrate by self-suction action, without the need for an extraneous suction cup member. It thereby resembles an oversized suction plate upon which information can be prominently displayed. The board can be removed, attached and reattached to substrates without damaging these substrates. The board can be lifted off the attached substrate by lifting of the beveled periphery of the board. Lifting of the periphery of the board releases the vacuum seal formed.

3 Claims, 2 Drawing Sheets

UNITARY FLEXIBLE INFORMATION PRESENTATION BOARD HAVING SELF-SUCTION

BACKGROUND OF THE INVENTION

1. Field of Invention

This invention relates to display devices in general and more specifically to a unitary self-suction display board.

2. Brief Description of the Prior Art

In the past few years there has been an increase in the use of stickers, particularly bumper stickers. Once a sticker has been attached to a substrate several problems arise. The sticker itself may deteriorate or the message on the sticker becomes dated, creating the desire to remove the sticker. Removal of the sticker all too often leads to substrate damage from the adhesive used or an unsightly residue may remain.

Over time the prior art indicates that there has been an attempt to reduce the damage caused by sticker adhesive. Most of these inventions consist of providing a fixed information board on to which a sticker can be temporarily affixed and later removed. U.S. Pat. Nos. 5,131,177 and 5,077,925 typify this class of inventions. However, the necessity of permanently attaching a board to a substrate adds expense and unsightliness.

Another area of art consists of adding extraneous suction cups to a message board for adhering the message to a substrate. See U.S. Pat. No. 5,080,941. However, the size and construction of the suction cup does not permit displaying a message on it, while the display board itself is a separate member.

A unitary construction which itself was a display board and succession plate which could have messages printed or painted thereon would be a welcomed advancement in the art.

SUMMARY OF THE INVENTION

The present invention comprises a unitary information presentation board which is intrinsically self-suctioning. The presentation surface of said board is designed to offer user options of directly printing information on said surface or said surface can serve as a medium to which adhesive backed printed matter can be firmly attached. The presentation board can be attached, detached or reattached to the body of an automobile, or other substrate area without an extraneous attaching means.

The present invention is constructed from flexible material such as rubber, intermediates or thermoplastic resin material preferably polyvinyl chloride. The exterior convex surface of said board can be characterized as a curved, sloping wall forming a suitable presentation surface. The interior concave surface is curved to form a concave cavity. The periphery of the presentation board is beveled.

DETAILED DESCRIPTION OF THE INVENTION

Figure 1:
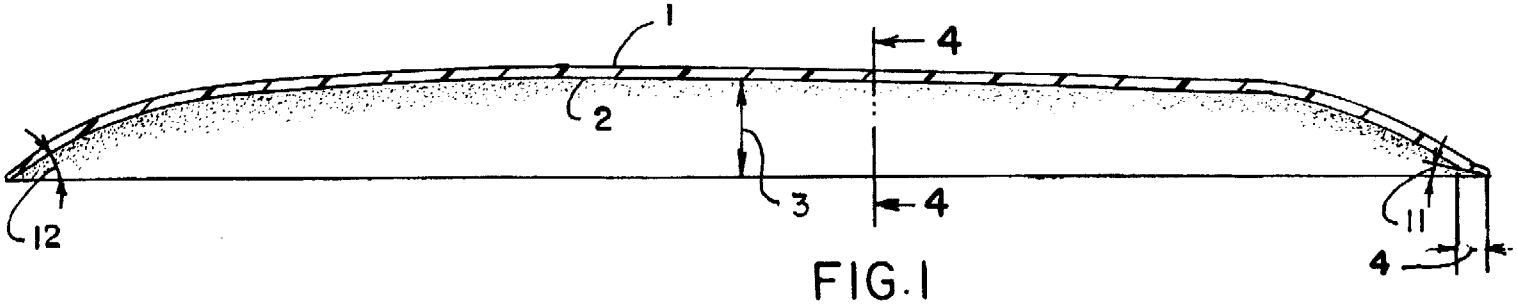
FIG. 1 is a cross sectional view of an elongated side panel of the board along line 1—1 of FIG. 4.

Referring first to FIG. 1, the flexible information presentation board there illustrated contains a convex exterior surface 1 and a concave interior surface 2, both of which are suitable for affixing a message. The interior concave side of said board forms a concave cavity 3 of measurable depth. The periphery 4 of the interior concave side of said board is beveled.

Figure 2:
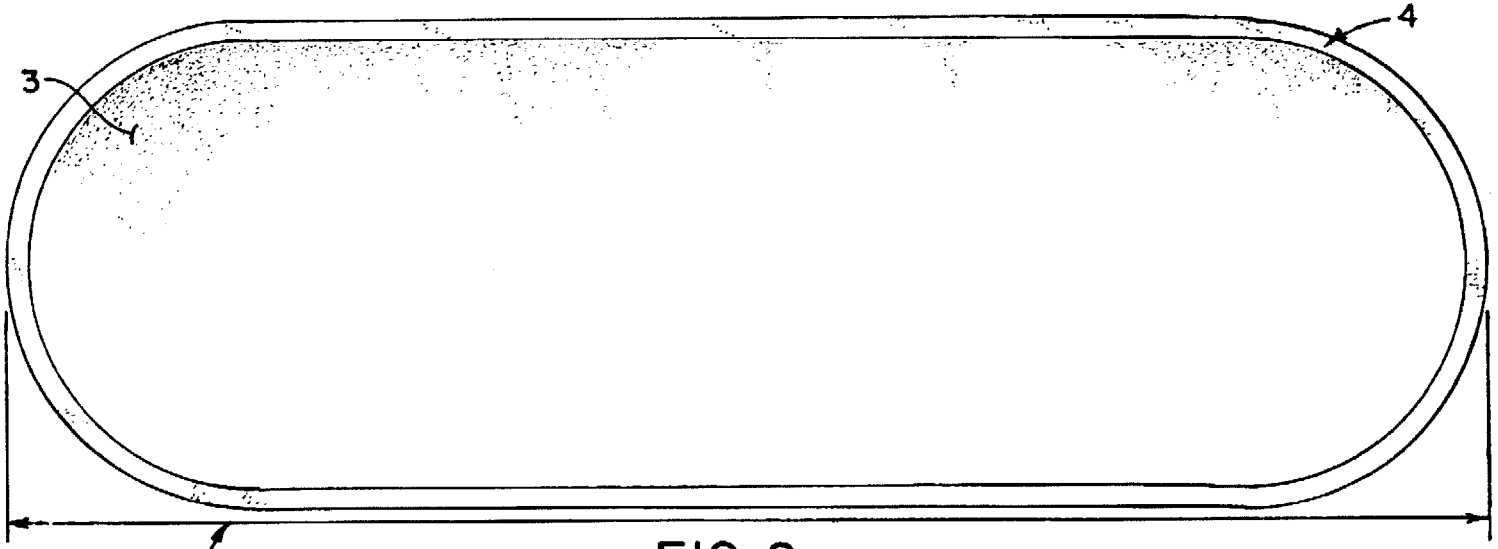
FIG. 2 is a bottom view into the interior concave surface area of the board. The beveled periphery of said board can be seen.
Figure 6:
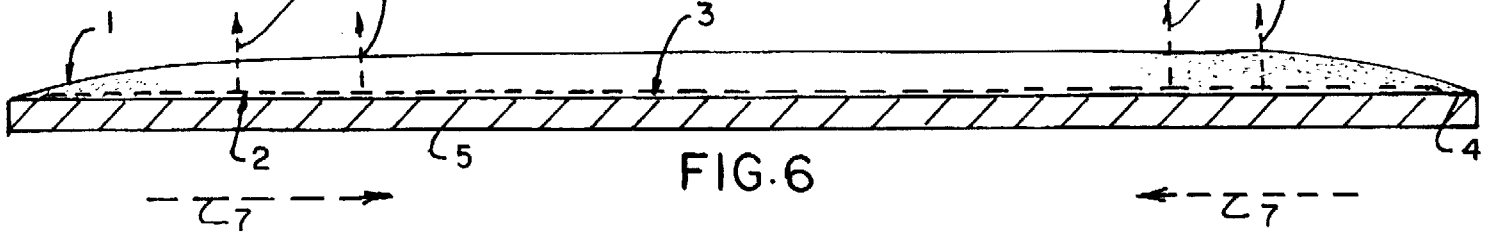
FIG. 6 is a frontal view of the board resting on a substrate while in a "flattened", depressed position.

Interior concave cavity 3 of said board can be seen in FIG. 2. The interior concave cavity of said board creates a vacuum by suction when said board is in "depressed position" of FIG. 6 while the periphery snugly rest on a substrate. This allows for attachment onto a variety of surfaces without damaging said surfaces. Referring to FIG. 6, it is believed that depressing said board causes evacuation of air molecules contained within concave cavity 3 and a subsequent differential pressure increase from the surrounding environment. A potential relationship which illustrates this rate of pressure increase as time elapses can be stated as follows:

$$dp/dt=Q/V$$

where dp represents the pressure differential, dt represents the change in time, Q represents the volume of gas which has permeated into the compressed cavity and V represents the volume of compressed cavity 3 at the time of pressure measurement. Although this relationship is not completely understood, it is believed this relationship is greatly influenced by the following factors:

1. The atmospheric pressure and temperature of the surrounding environment and within the compressed cavity.
2. The porosity and wall thickness of the display board.
3. The volume of concave cavity 3 prior to being compressed.
4. The surface condition to which the board will be affixed.
5. The seal formed by beveled periphery 4.
6. The viscoelastic behavior of the material used to construct the display board.

Figure 4:
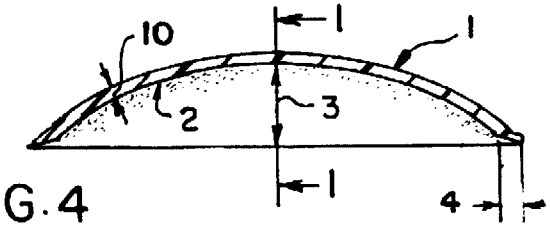
FIG. 4 is a cross sectional view of one end of the board along lines 4—4 of FIG. 1.
Figure 3:
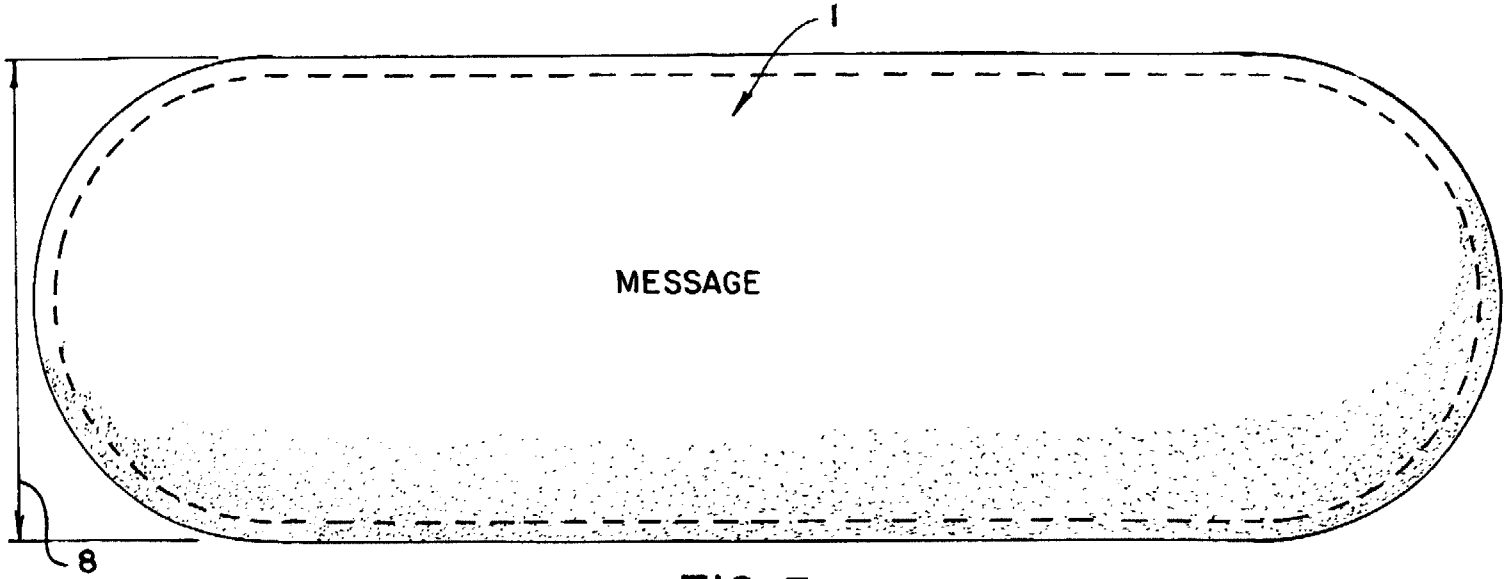
FIG. 3 is a top view onto the exterior convex surface area of the board.
Figure 5:
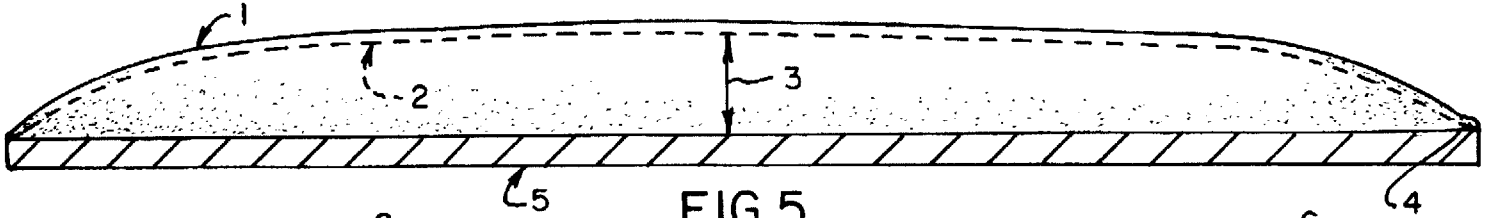
FIG. 5 is a frontal perspective of the board resting on a substrate while in a "relaxed" position.

Referring to FIG. 6, said board is under considerable tension when in a "flattened", depressed shape. The viscoelastic nature of the board's distorted walls causes it to "flex" in an effort to return to its "relaxed", convex shape as illustrated in FIG. 5. In FIG. 6, said flexing behavior causes upward vacuum force 6 to be exerted. The magnitude of vacuum force 6 is greatly influenced by the depth of concave cavity 3. We have found that the greater the depth of concave cavity 3, the greater the magnitude of vacuum force 6 which is exerted when said board is depressed. Preferably the depth of concave cavity 3 is selected such that the ratio of the dimensions of the point of maximum cavity depth and the width of said board is 0.167 or greater. Referring to FIG. 3 and FIG. 4, this ratio can be calculated as follows:

$$\text{Ratio} = \frac{\text{maximum cavity depth}}{\text{width of board}} = \frac{.5075''}{3.045''} = 0.167$$

It is believed a ratio of 0.167 or greater will ensure an adequate vacuum force is generated when said board flexes when in a depressed shape.

The ends of the preferred rectangular embodiment of the present invention are preferably rounded; and therefore reduces the amount of material used to construct said board illustrated in FIG. 2. Periphery 4 of the interior concave side of said board is beveled. The slope of the beveled surface depends upon the depth of concave cavity 3. In the embodiment illustrated in FIG. 1, it is preferred that beveled periphery 4 forms angle 12 which is about 30° when said board is in a convex shape. This angle will enable said periphery to rest flat upon a substrate when said board is depressed. As illustrated in FIG. 6, beveled periphery 4 serves as a seal which harnesses vacuum force 6 by minimizing the untimely release of said force. Beveled periphery 4 is preferably about 5/32" in width and about 1/32" in wall thickness. This wall thickness provides a highly flexible surface area which forms a snug seal when said board flexes.

Said board has curved, sloping walls which preferably are uniform in thickness 10 as illustrated in FIG. 4. We have found that the degree of thickness and viscoelastic nature of said walls influences the magnitude of upward vacuum force 6. In FIG. 1, the board there illustrated has curved walls which preferably forms angle 11 which is about 12° at the point of contact with the substrate. We have found that a board provides suitable presentation surface when the slope at the point of contact at the shortened end of said board ranges between 12° and 35°. The board illustrated in FIG. 1 has difficulty remaining in a flattened shape when angle 11 exceeds 24°. Preferably the length is from about 8" to 18", given the above described dimension.

Referring to FIG. 6, the air pressure inside compressed cavity 3 rises as air molecules permeate into said cavity. It is believed this increased pressure magnifies vacuum force 6 by pushing outwardly on the inner walls of said cavity. Said pressure increase eventually enables said board to overcome frictional force 7 which is generated when beveled periphery 4 slides along surface 5 due to said flex process; and the compressed cavity slowly expands as the air pressure increases toward equilibrium with the surrounding environment. This expansion continues until the air pressure reaches equilibrium and the depressed board resumes its original convex shape as illustrated in FIG. 5.

As illustrated in FIG. 2 and FIG. 3, said board provides a suitable surface for affixing a message. Said message can be attached to a surface and will remain fastened to said surface as long as said board remains in a depressed position. Said flattened board can be subsequently removed from a substrate by pulling upward on beveled periphery 4; thereby releasing said board's vacuum force. Re-attachment of said board can be achieved by placing the interior concave side of said board snugly against a substrate and depressing said board once again.

It is believed numerous theoretical display boards of varying shape and size are capable of being constructed which incorporates the spirit of the present invention. The rectangular shaped embodiment illustrated in the accompanying drawings is preferred and submitted for the purpose of demonstrating the theory related to the effective design and utilization of a display board made in accordance with the present invention. It will be obvious to those skilled in the art that various changes may be made without departing from the scope of the invention and the invention is not to be considered limited to what is illustrated in the drawings and described in the specification.

What is claimed is:

1. A unitary, rectangular-shaped, and flexible information presentation board sheet which can be used for bumper sticker display, said board sheet comprising:

a. a beveled-periphery, b. a length of from about eight inches to about eighteen inches, c. a width, d. an exterior surface from which a message is displayed, e. an interior surface, said interior surface forming a concave cavity having a slope between about 12° and 24°, and f. a maximum cavity depth/width ratio of at least 0.167;

wherein vacuum force, generated when the concave cavity is depressed, enables the board to adhere by self-suction of its beveled periphery against the substrate, without the need for other extraneous attaching means.

2. The unitary presentation board sheet of claim 1 wherein the beveled periphery is about 5/32 inch in width and about 1/32 inch in wall thickness.

3. The unitary presentation board sheet of claim 1 made from polyvinyl chloride.

* * * * *